US009266246B2

(12) United States Patent
Schmitt

(10) Patent No.: US 9,266,246 B2
(45) Date of Patent: Feb. 23, 2016

(54) DRIVE COMPONENT FOR ELECTRIC SHAVER

(71) Applicant: Spectrum Brands, Inc., Middleton, WI (US)

(72) Inventor: Paul Allen Schmitt, Madison, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 229 days.

(21) Appl. No.: 14/142,043

(22) Filed: Dec. 27, 2013

(65) Prior Publication Data

US 2014/0182136 A1 Jul. 3, 2014

Related U.S. Application Data

(60) Provisional application No. 61/747,591, filed on Dec. 31, 2012.

(51) Int. Cl.
*B26B 19/14* (2006.01)

(52) U.S. Cl.
CPC ..... *B26B 19/14* (2013.01); *B26B 19/141* (2013.01)

(58) Field of Classification Search
CPC ..... B26B 19/14; B26B 19/141
USPC ..... 30/43.4
See application file for complete search history.

(56) References Cited

U.S. PATENT DOCUMENTS 1,379,880 A * 5/1921 Seaborn ..... A61C 1/12 279/35
1,983,094 A * 12/1934 Neher ..... F16D 3/74 464/79
2,242,405 A * 5/1941 Sussman ..... B26B 19/26 30/346.51
2,280,052 A * 4/1942 Bahr ..... B26B 19/14 30/41.6
3,472,045 A * 10/1969 Nelsen ..... A61C 17/005 415/122.1
3,679,035 A * 7/1972 Schmitt ..... B01D 33/067 192/129 A
RE30,857 E * 2/1982 Tyler ..... B26B 19/145 30/43.5
4,329,781 A * 5/1982 Schemmann ..... B26B 19/42 30/34.2

(Continued)

*Primary Examiner* — Sean Michalski
(74) *Attorney, Agent, or Firm* — Armstrong Teasdale LLP

(57) ABSTRACT

An electric shaver generally includes a handle and a head connected to the handle. The head includes an outer cutter blade and an inner cutter blade arranged in shearing contact with the outer cutter blade. The electric shaver further includes a drive system having a motor and a plurality of drive components drivingly connecting the motor to the inner cutter blade for driving rotation of the inner cutter blade relative to the outer cutter blade. The plurality of drive components includes a first drive component and a second drive component connected to the first drive component. At least one of the first drive component and the second drive component has a liner for cushioning the interface between the first drive component and the second drive component to mitigate noise associated with operation of the shaver.

20 Claims, 15 Drawing Sheets

(56) References Cited

U.S. PATENT DOCUMENTS 4,343,086 A * 8/1982 de Vries ..... B26B 19/42 30/43.6
4,391,594 A * 7/1983 Hannibal ..... F16D 3/725 464/80
D288,251 S * 2/1987 Izumi ..... F16D 3/725 D28/45
4,688,329 A * 8/1987 Oord ..... B26B 19/146 30/43.6
4,729,169 A * 3/1988 Asawa ..... B26B 19/141 30/346.51
4,841,929 A * 6/1989 Tuggle ..... F01B 1/12 123/185.3
5,031,315 A * 7/1991 Labrijn ..... B26B 19/14 30/41
5,035,055 A * 7/1991 McCullough ..... B26B 25/002 30/276
5,108,273 A * 4/1992 Romanyszyn, Jr. ... F04C 2/1073 137/99
5,156,547 A * 10/1992 Bailey ..... A61C 17/005 433/125
5,423,679 A * 6/1995 Bailey ..... A61C 17/005 433/125
5,551,918 A * 9/1996 Jones ..... F16D 3/725 464/147
5,573,463 A * 11/1996 Arlt ..... F16D 3/76 464/147
5,794,514 A * 8/1998 Pecorari ..... F04B 1/124 417/269
5,902,107 A * 5/1999 Lowell ..... A61C 1/12 433/112
6,212,776 B1 * 4/2001 Izumi ..... B26B 19/14 30/43.4
6,226,870 B1 * 5/2001 Barish ..... B26B 19/14 30/34.2
6,581,289 B2 * 6/2003 Nakano ..... B26B 19/145 30/346.51
6,707,208 B2 * 3/2004 Durham ..... H02K 21/042 310/156.35
7,178,242 B2 * 2/2007 Okabe ..... B26B 19/141 30/346.51
7,422,433 B2 * 9/2008 Carron ..... A61C 17/005 433/125
7,698,819 B2 * 4/2010 De Wit ..... B26B 19/3846 30/43.5
8,915,404 B2 * 12/2014 Farne' ..... G01F 11/021 1/21
9,027,251 B2 * 5/2015 Schmitt ..... B26B 19/14 30/41
2002/0083591 A1 * 7/2002 Geertsma ..... B26B 19/143 30/43.6
2006/0169524 A1 * 8/2006 Born ..... B62D 1/181 180/444
2007/0084059 A1 * 4/2007 Hannan ..... B26B 19/14 30/43.5
2013/0053966 A1 * 2/2013 Jimenez ..... A61F 2/447 623/17.16
2014/0012237 A1 * 1/2014 Pribanic ..... A61B 17/07207 606/1
2014/0024563 A1 * 1/2014 Heidecker ..... F04C 15/0003 508/106

* cited by examiner

DRIVE COMPONENT FOR ELECTRIC SHAVER

CROSS REFERENCE TO RELATED APPLICATION

This application claims priority to Provisional Patent Application Ser. No. 61/747,591, filed on Dec. 31, 2012, which is incorporated herein by reference in its entirety.

BACKGROUND

The present invention relates generally to electric shavers and, more particularly, to a drive component for an electric shaver.

Conventional rotary shavers include a handle and a head mounted on the handle, and the head carries at least one set of inner and outer cutters. The outer cutters are typically cup-shaped and are supported by a frame of the shaver head, thereby collectively defining a skin contacting surface of the shaver head. Openings or slits formed in the outer cutters allow hair to protrude through the outer cutters as the shaver head is moved along the skin. Each inner cutter is housed in the shaver head below, and in contact with, a respective one of the outer cutters. The shaver is operated via an electric motor, typically housed within the handle, whereby rotation of the inner cutters by the motor acts to cut hairs protruding through the outer cutters. An arrangement of drive shafts and gears is conventional for operatively connecting the inner cutters to the motor.

The outer cutters of at least some conventional rotary shavers are configured for pivoting movement on the shaver head to facilitate uninterrupted contact of the outer cutters with the skin as the outer cutters are moved along the contours of the skin (e.g., along the skin covering the cheek bones, the jaw line, etc.) Because the inner cutters are disposed within the outer cutters, it is also typical for the inner cutters to be configured for pivoting movement to facilitate maintaining shearing engagement between the inner and outer cutters when the outer cutters pivot.

In that regard, the shaver drive system typically has at least one pivot joint located between the motor and the inner cutters to enable driving of the inner cutters during pivoting. The pivot joint therefore includes at least one rotating component that can pivot relative to another rotating component. However, the engagement of these rotating and pivoting components can be a source of undesirable noise during operation of the shaver. As such, there is a need for a drive system that facilitates quieter operation of a rotary shaver having pivotable cutters.

SUMMARY

In one embodiment, an electric shaver generally comprises a handle and a head connected to the handle. The head comprises an outer cutter blade and an inner cutter blade arranged in shearing contact with the outer cutter blade. The electric shaver further comprises a drive system comprising a motor and a plurality of drive components drivingly connecting the motor to the inner cutter blade for driving rotation of the inner cutter blade relative to the outer cutter blade. The plurality of drive components comprises a first drive component and a second drive component connected to the first drive component. At least one of the first drive component and the second drive component comprises a liner for cushioning the interface between the first drive component and the second drive component to mitigate noise associated with operation of the shaver.

In another embodiment, an inner cutter for an electric shaver generally comprises a blade and a drive cap to which the blade is connected. The drive cap comprises a shell and a liner, wherein an interior of the shell is lined by the liner such that the liner defines a socket. The shell is formed from a first material having a first hardness, and the liner is formed from a second material having a second hardness that is less than the first hardness.

In yet another embodiment, an electric shaver generally comprises a handle and a head connected to the handle. The head includes an outer cutter blade and an inner cutter blade arranged in shearing contact with the outer cutter blade. The electric shaver further includes a drive system comprising a motor and a plurality of drive components drivingly connecting the motor to the inner cutter blade for driving the inner cutter blade relative to the outer cutter blade. The plurality of drive components comprises a drive cap to which the inner cutter blade is connected. The drive cap includes a shell and a liner, wherein an interior of the shell is lined by the liner such that the liner defines a socket. The shell is formed from a first material having a first hardness, and the liner is formed from a second material having a second hardness that is less than the first hardness. The drive system further includes a torque transfer assembly comprising a basket, a biasing member seated within the basket, and a drive pin connected to the basket atop of the biasing member such that the drive pin is floatable, pivotable, and rotatably immovable relative to the basket. The torque transfer assembly drivingly connects the motor to the drive cap with the drive pin inserted into the socket such that the liner cushions the interface between the drive pin and the drive cap to mitigate noise associated with operation of the shaver.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
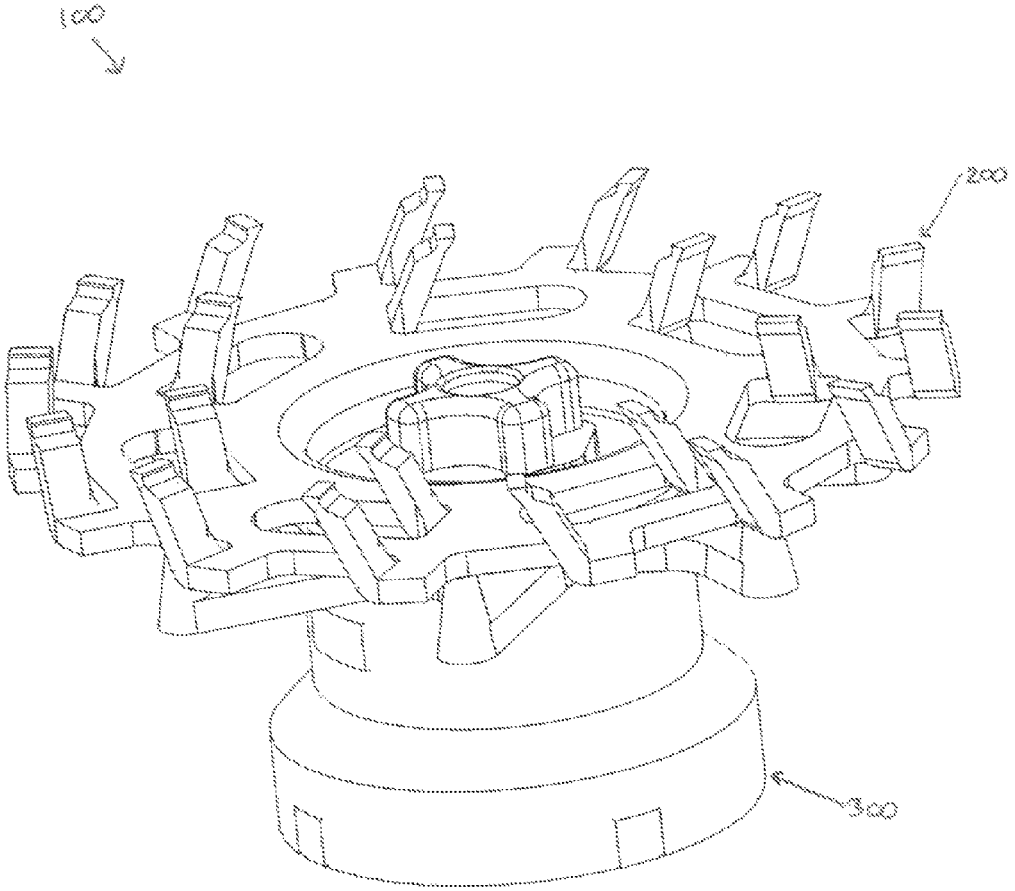
FIG. 1 is a perspective view of one embodiment of an inner cutter.
Figure 2:
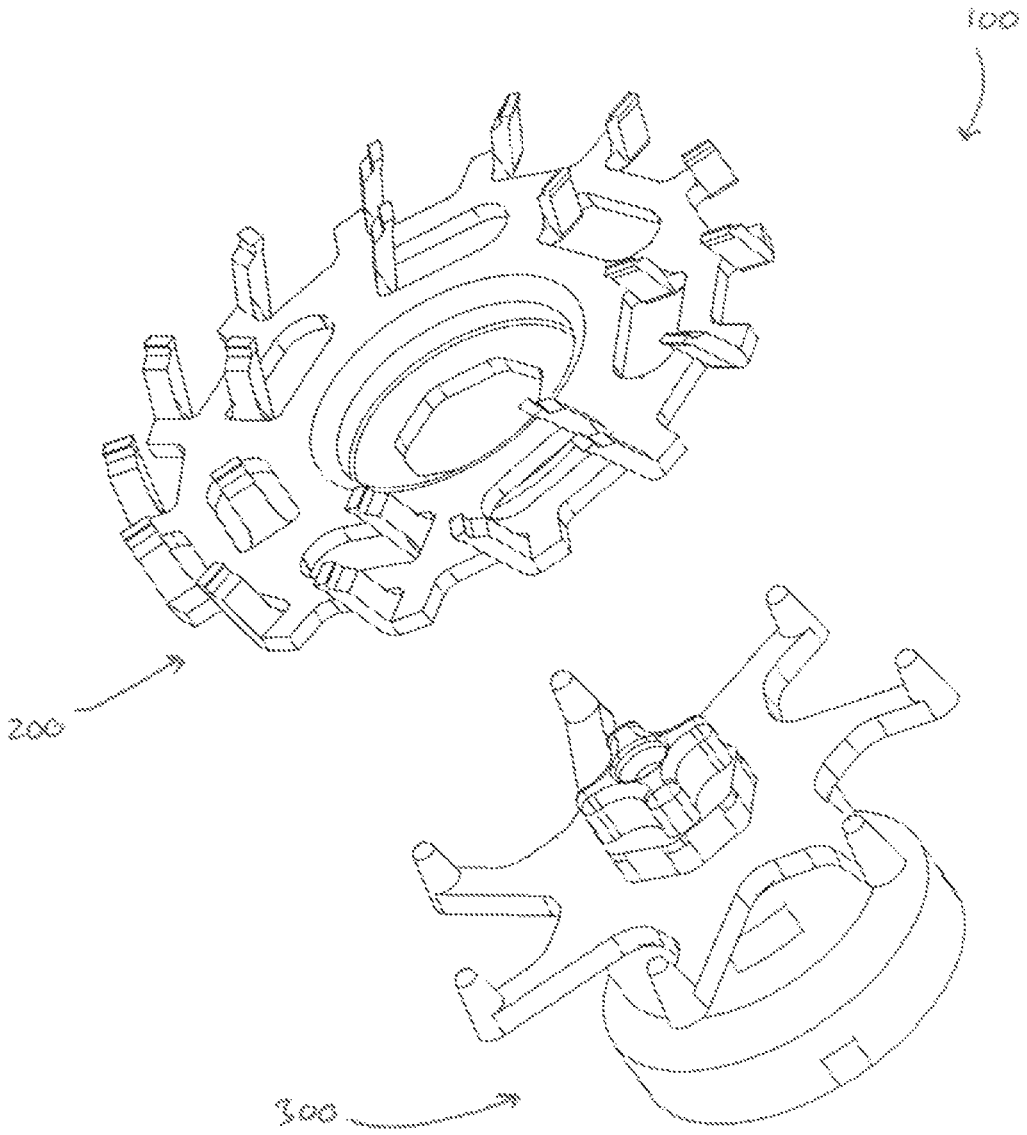
FIG. 2 is an exploded perspective view of the inner cutter of FIG. 1.
Figure 3:
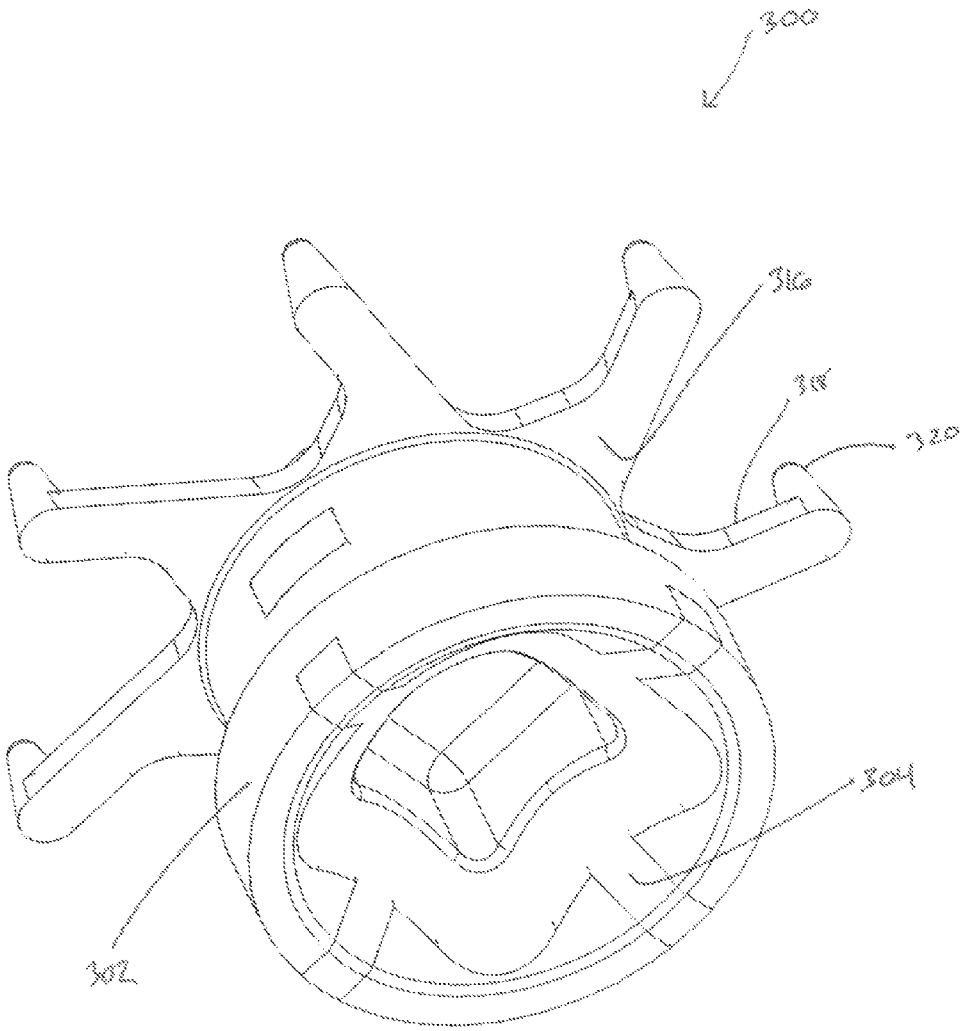
FIG. 3 is a bottom perspective view of a drive cap of the inner cutter of FIG. 1.
Figure 4:
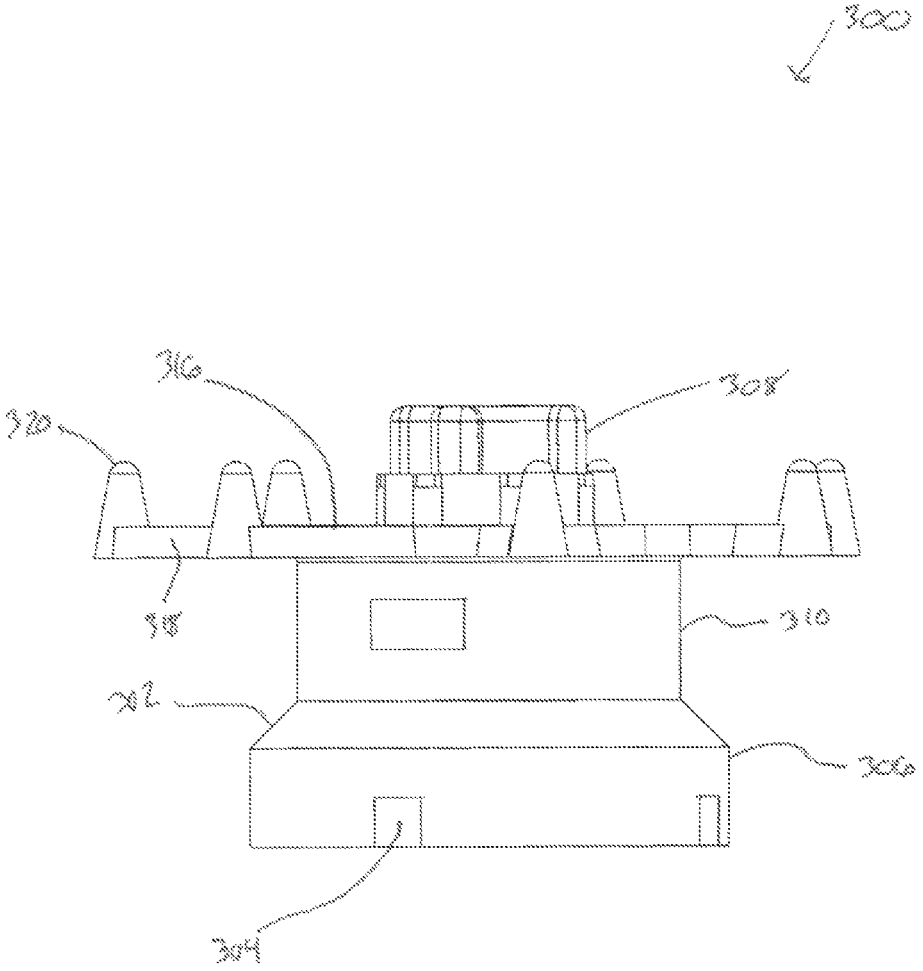
FIG. 4 is a side elevation of the drive cap of FIG. 3.
Figure 5:
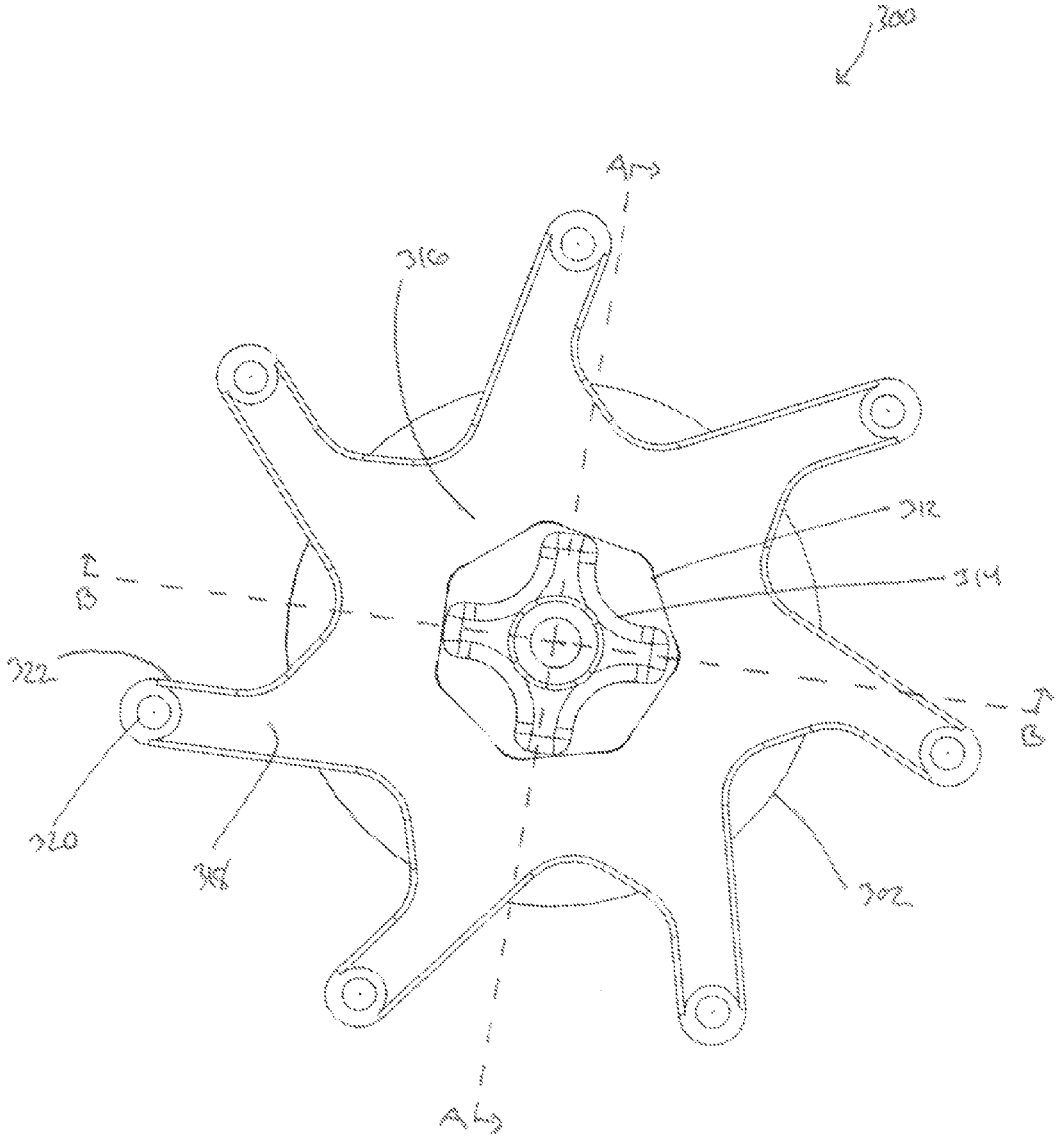
FIG. 5 is a top plan view of the drive cap of FIG. 3.

Referring now to the drawings, and in particular to FIGS. 1 and 2, a movable or inner cutter according to one embodiment is generally indicated by the reference numeral 100. The inner cutter 100 includes a blade, indicated generally at 200, and a drive cap, indicated generally at 300.

With reference now to FIGS. 3-6, the drive cap 300 includes a shell 302 and a liner 304. The shell 302 and the liner 304 are each formed from a synthetic or semi-synthetic, organic-based material (e.g., a "plastic" material), as described in more detail below. The shell 302 has a lower portion 306, an upper portion 308, and an intermediate portion 310 between the lower portion 306 and the upper portion 308. The illustrated upper portion 308 has a base 312, a head 314 projecting from the base 312, and a platform 316 extending outward from the base 312. The base 312 has a generally polygonal profile (e.g., a heptagonal profile in the preferred embodiment), and the head 314 has a generally cross-shaped profile. The platform 316 has a plurality of spaced-apart, outward extending arms 318 arranged such that the platform 316 is generally star-shaped or pinwheel-shaped, and a stud 320 projects upward from a distal region 322 of each arm 318. In this manner, the blade 200 may be seated on the drive cap 300 (e.g., about the base 312 and atop of the studs 320) for suitable fastening of the blade 200 to the drive cap 300 (e.g., via heat staking of the base 312 over a segment of the blade 200). In other embodiments, the base 312, the head 314, and the platform 316 may be configured in any suitable manner that facilitates fastening the blade 200 to, and supporting the blade 200 on, the drive cap 300 during operation of the shaver.

The illustrated lower and intermediate portions 306, 310 of the shell 302 are generally cylindrical on the exterior and are hollow on the interior. Lining the hollow interior of the shell 302 is the liner 304, which is sized to receive a drive pin 406 (FIGS. 14 and 15) for rotating the blade 200 during operation of the shaver. In the illustrated embodiment, the shell 302 and the liner 304 are formed using a double-injection molding process (i.e., each die has two cavities, which permits the drive cap 300 to be formed in one injection cycle). For example, after the liner 304 is formed in a first cavity of the die, the die is rotated 180°, and the liner 304 is inserted into the second cavity of the die such that the shell 302 is formed on the exterior of the liner 304 in the second cavity. After the shell 302 is formed on the liner 304, the drive cap 300 is ejected. In other embodiments, the shell 302 and the liner 304 may be formed in any suitable manner (i.e., in any suitable order using any suitable manufacturing process).

Figure 7:
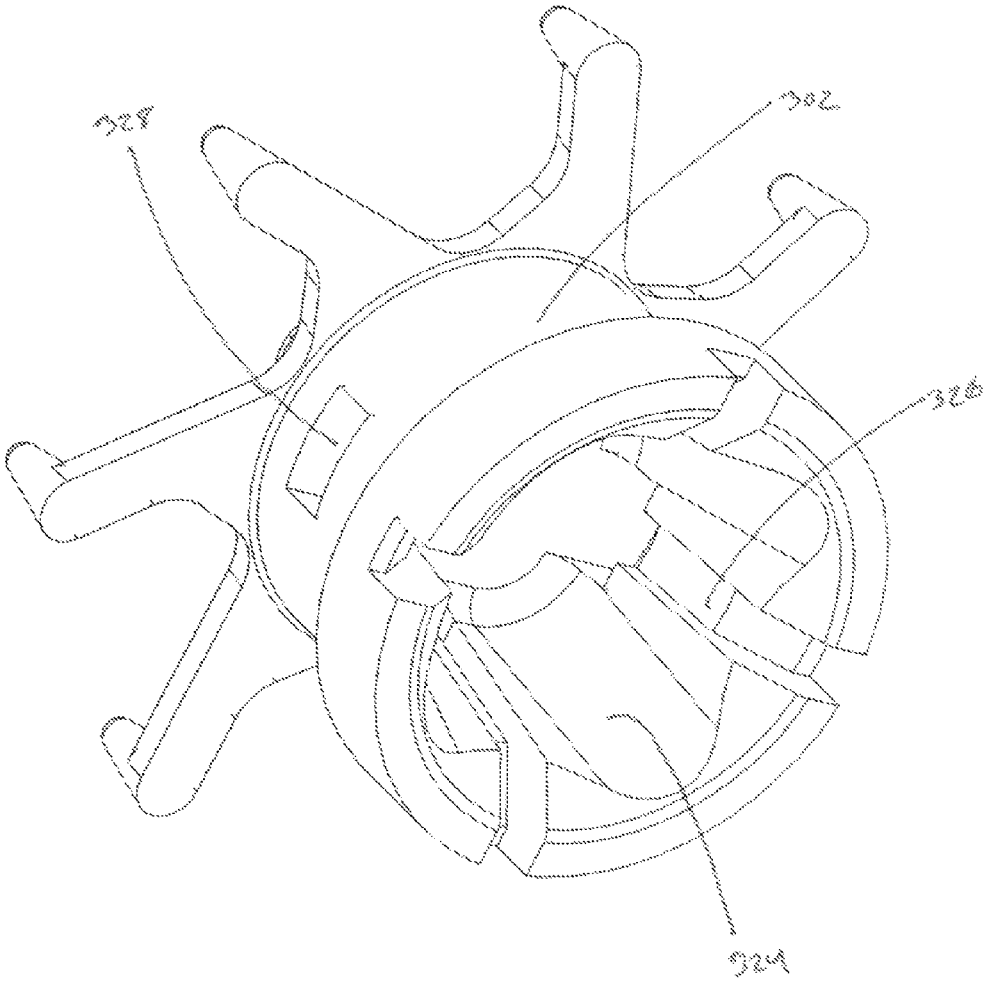
FIG. 7 is a bottom perspective view of a shell of the drive cap of FIG. 3.
Figure 8:
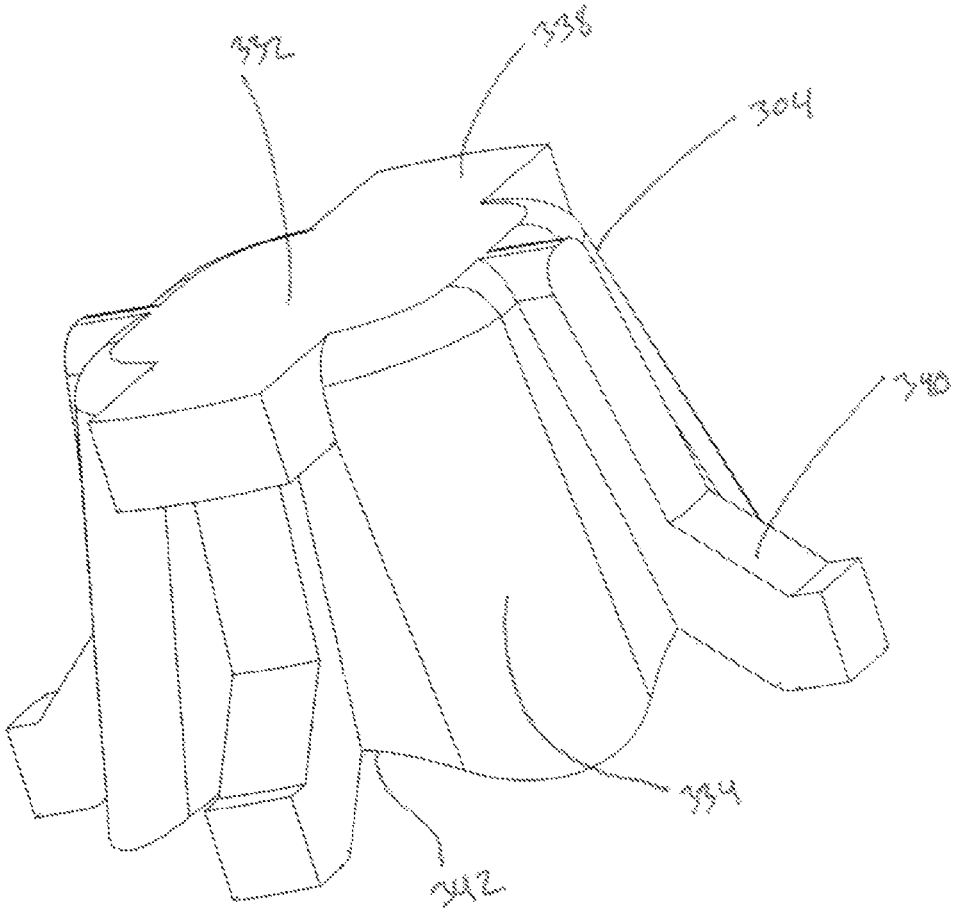
FIG. 8 is a top perspective view of a liner of the drive cap of FIG. 3.
Figure 9:
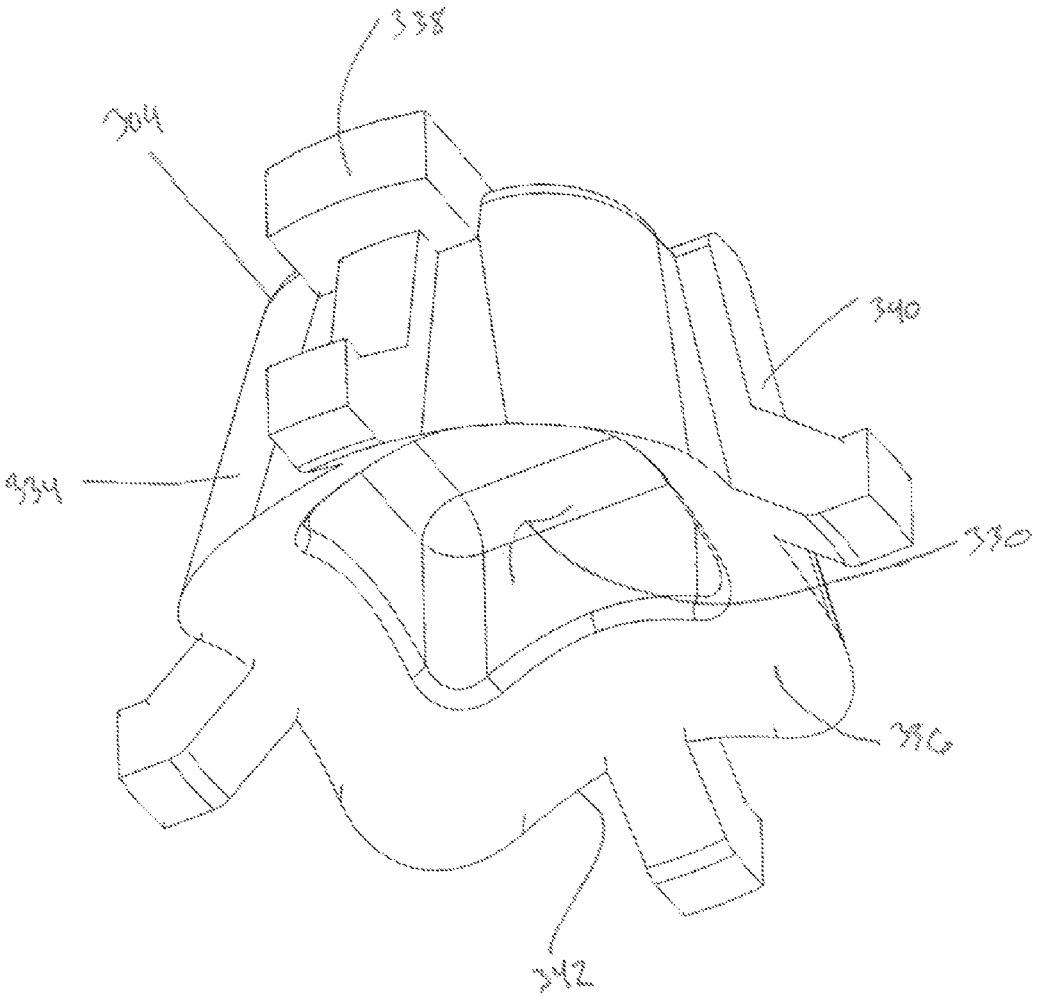
FIG. 9 is a bottom perspective view of the liner of FIG. 8.
Figure 10:
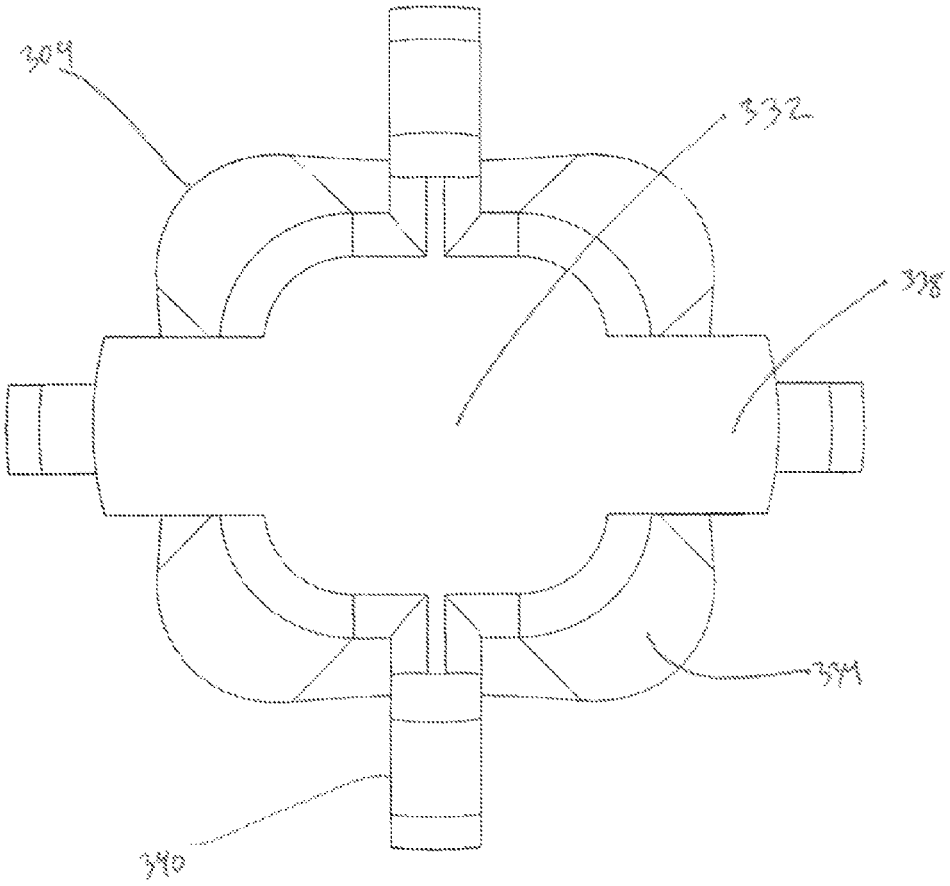
FIG. 10 is a top plan view of the liner of FIG. 8.

FIG. 7 illustrates the interior of the shell 302 without the liner 304. As described above, the shell 302 is formed over the liner 304 such that the interior shape of the shell 302 mirrors the exterior shape of the liner 304. More specifically, an interior surface 324 of the shell 302 defines a plurality of spaced-part, lengthwise-extending grooves 326 and a plurality of opposed throughports 328 located above the grooves 326. In one embodiment, the shell 302 has four grooves 326 that are equally spaced about the interior of the shell 302, and the shell has two throughports 328. Each of the throughports 328 is aligned with, and connected to, one of two opposing grooves 326. Alternatively, the shell 302 may include any suitable number of grooves 326 and any suitable number of throughports 328 arranged in any suitable manner.

FIGS. 8-11 illustrate the liner 304 without the shell 302 (i.e., before the shell 302 has been formed over the exterior of the liner 304). The liner 304 is generally cup-shaped and is inverted to define a socket 330. The liner 304 is closed at the top by a top wall 332 and is open at the bottom within a side wall 334 having an undulating bottom surface 336. The top wall 332 has a pair of opposed ledges 338 extending outward near the top of the side wall 334, and the side wall 334 has a plurality of generally L-shaped tongues 340 projecting therefrom and extending downward from the top wall 332 beyond valley regions 342 of the undulating bottom surface 336. In the illustrated embodiment, the liner 304 has four tongues 340 that are equally spaced-apart from one another, and a pair of the tongues 340 is aligned with the opposed ledges 338 such that each of the opposed ledges 338 is connected to one of the tongues 340. In other embodiments, the liner 304 may have any suitable number of ledges 338 and tongues 340 arranged in any suitable manner.

In one embodiment, the liner 304 is formed from a thermoplastic elastomer (TPE) material. In the illustrated embodiment, the TPE material is a thermoplastic polyurethane (TPU) material that is polyether-based (e.g., the "Elastollan 1174D" material produced by BASF), which provides the liner 304 with desirable noise mitigation properties and wear resistance properties, as described in more detail below. For example, the TPU material of the illustrated liner 304 may have the following properties: a specific gravity of about 1.19 g/cm$^3$; a shore hardness of about 73D (Shore A or D); a taber abrasion of about 75 mg loss; a DIN abrasion of about 35 mm$^3$ loss; an E-modulus of about 76,000 psi; a flexural modulus of about 73,000 psi; a tensile strength of about 7,100 psi; a tensile stress at 1000 elongation of about 5,600 psi; a tensile stress at 3000 elongation of about 7,100 psi; an ultimate elongation of about 3000; a tear strength of about 1,600 lb/in; a compression set of about 600 of original deflection for 22 h at 70° C. and about 400 of original deflection for 22 h at 23° C.; a glass transition temperature of about 33° C.; a vicat softening temperature of about 160° C.; and a DMA softening temperature of about 148° C. In one embodiment, the liner 304 has a thickness of about 0.7-1.0 mm. In other embodiments, the liner 304 may be formed from any suitable material and may have any suitable thickness.

Figure 6:
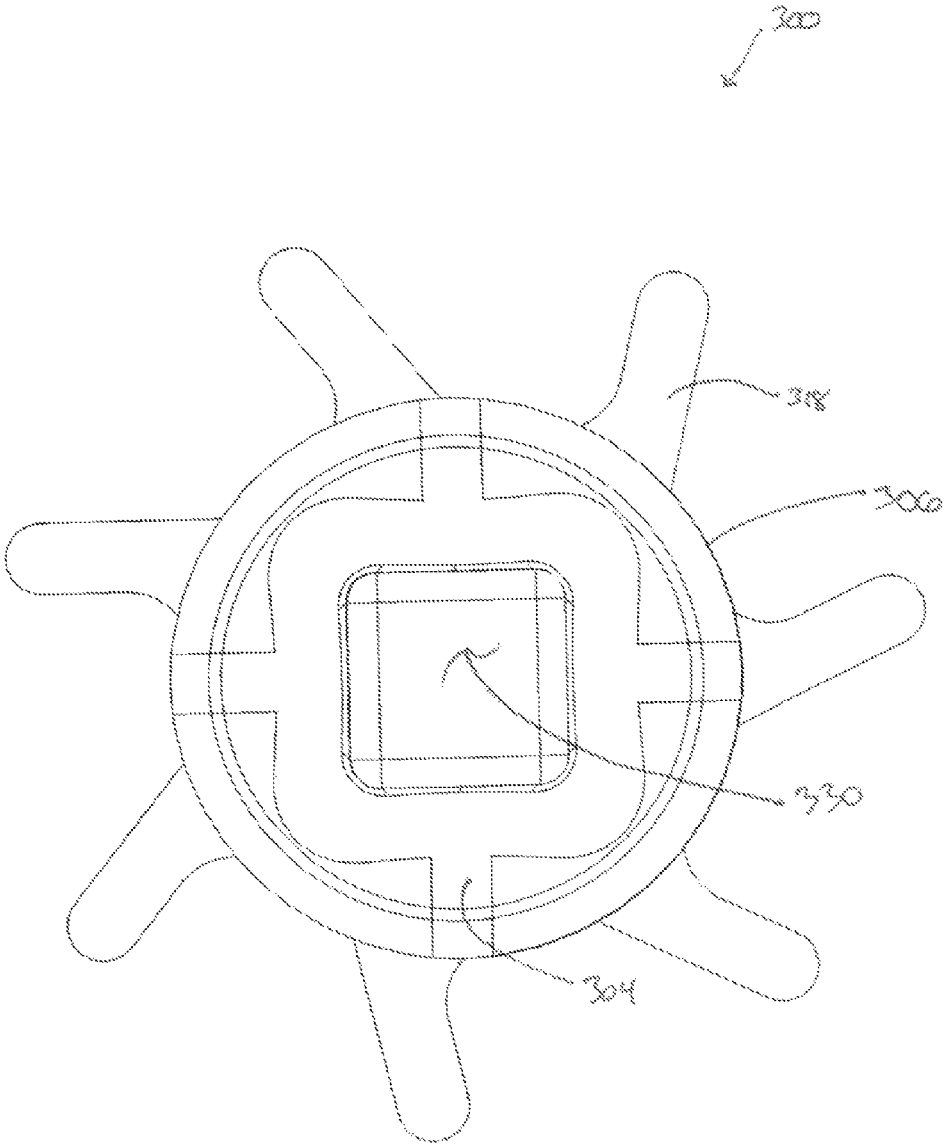
FIG. 6 is a bottom plan view of the drive cap of FIG. 3.
Figure 11:
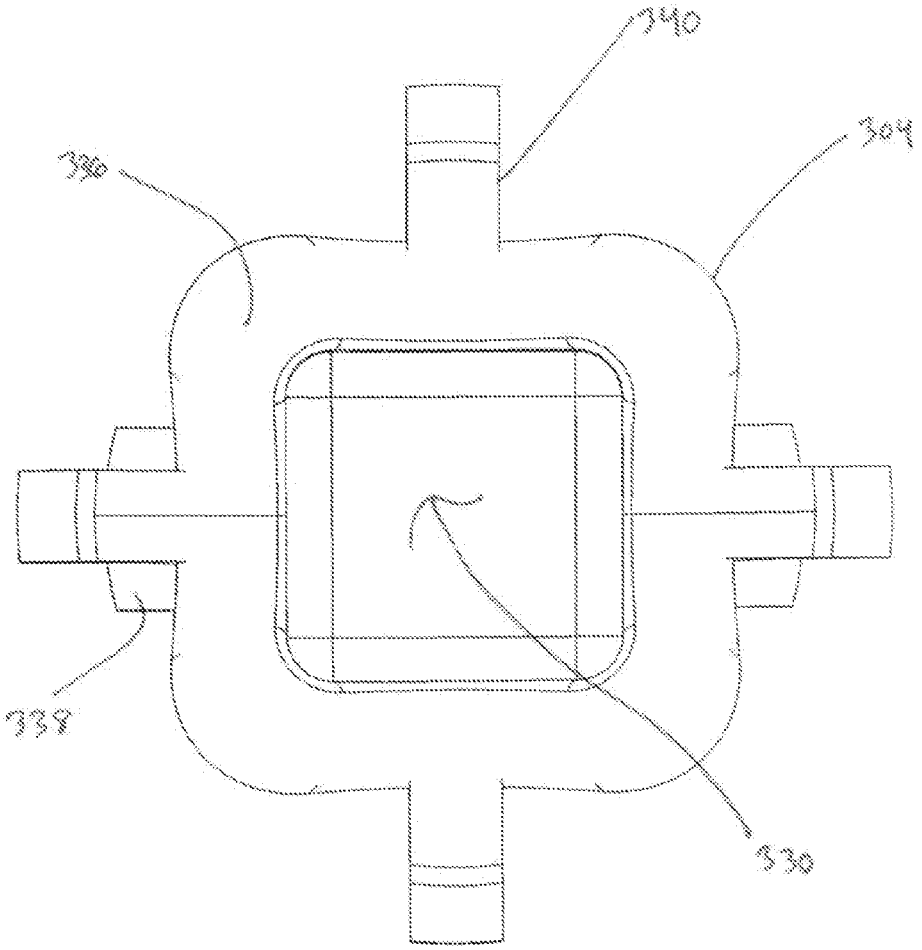
FIG. 11 is a bottom plan view of the liner of FIG. 8.
Figure 12:
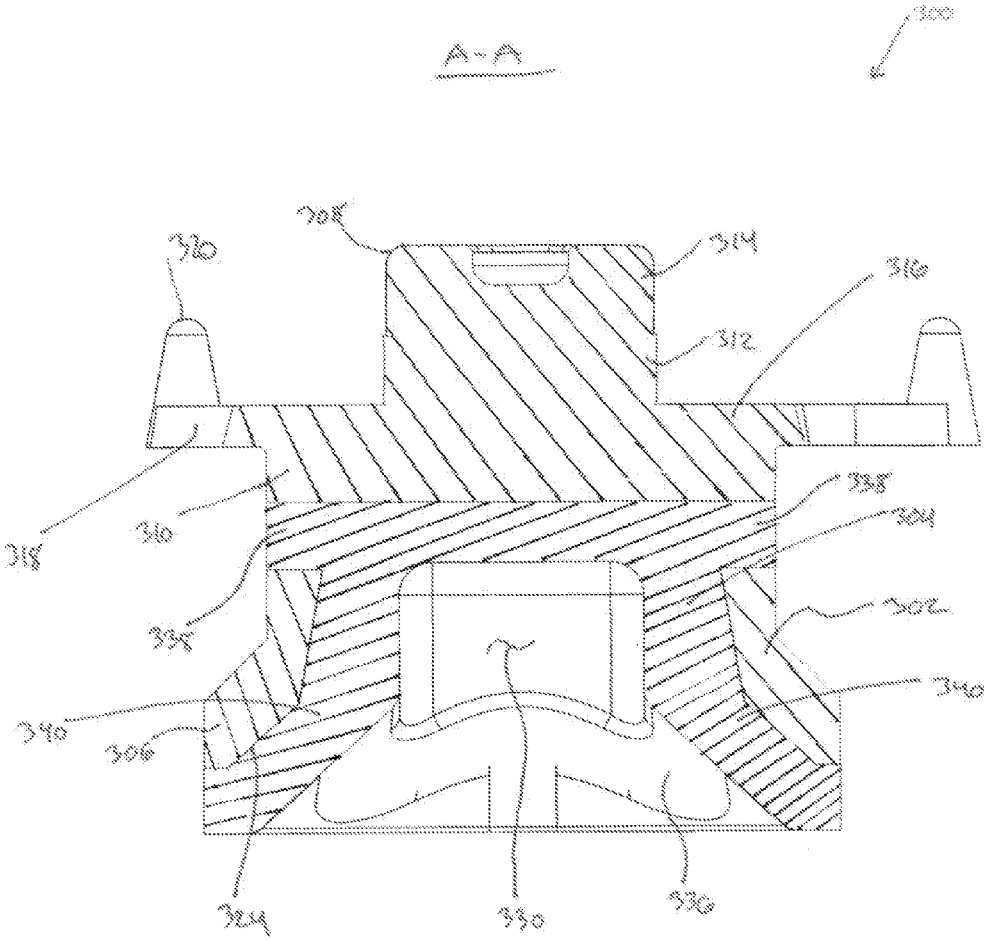
FIG. 12 is a cross-sectional view of the drive cap of FIG. 5 taken along plane A-A.
Figure 13:
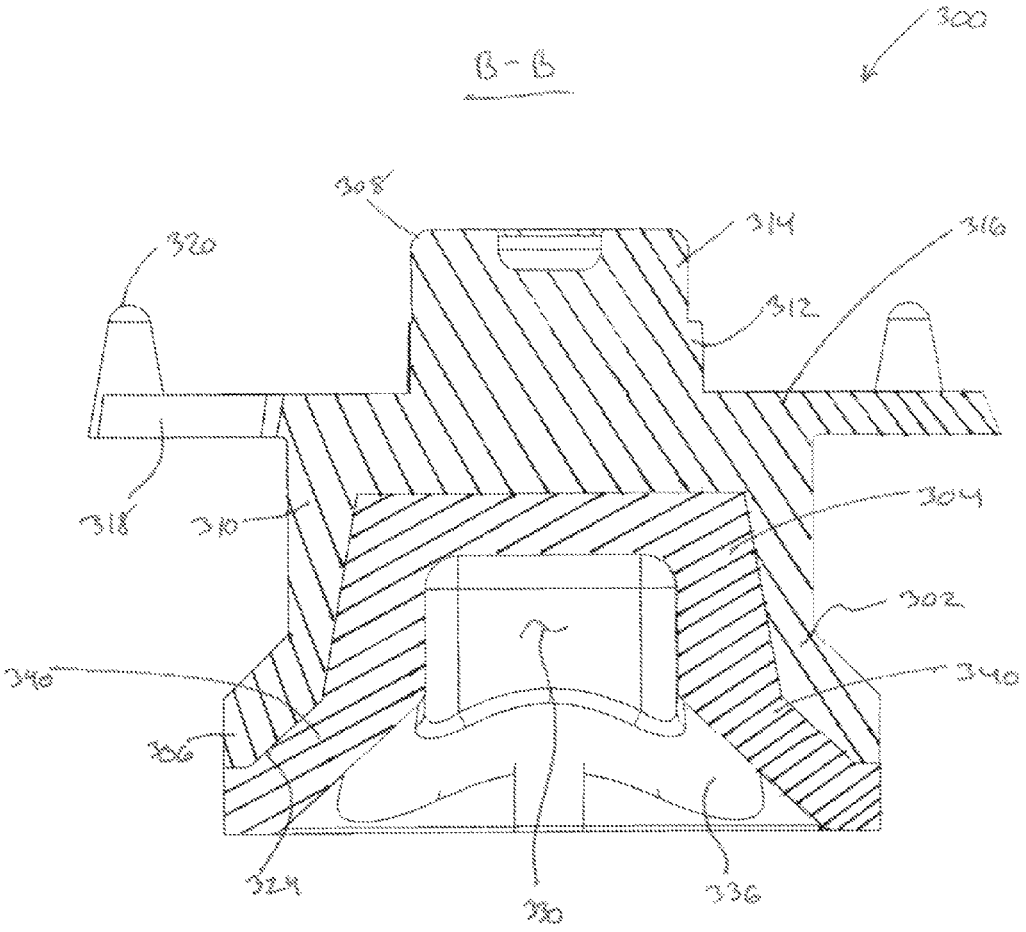
FIG. 13 is a cross-sectional view of the drive cap of FIG. 5 taken along plane B-B.

FIGS. 12 and 13 are sections of the drive cap 300 in its assembled configuration (i.e., with the shell 302 formed over the liner 304). The liner 304 defines the socket 330 within the shell 302, and the socket 330 is generally polygonal when viewed from below (e.g., the socket 330 has a generally square cross-sectional shape in one embodiment) (FIGS. 6 and 11). Suitably, the socket 330 may be shaped in any manner that facilitates transmitting torque to the blade 200. In the illustrated embodiment, each of the tongues 340 is aligned with and extends into one of the grooves 326, and each of the ledges 338 is aligned with and extends into one of the throughports 328. In this manner, the shell 302 and the liner 304 are keyed to one another (e.g., in a tongue-and-groove or splined arrangement) to facilitate preventing rotation of the liner 304 relative to the shell 302. Additionally, because the ledges 338 extend into the throughports 328, removal of the liner 304 from the shell 302 is inhibited. In other embodiments, the shell 302 and the liner 304 may be keyed together in any suitable manner that facilitates preventing rotation of the liner 304 within the shell 302 and/or removal of the liner 304 from the shell 302.

Figure 14:
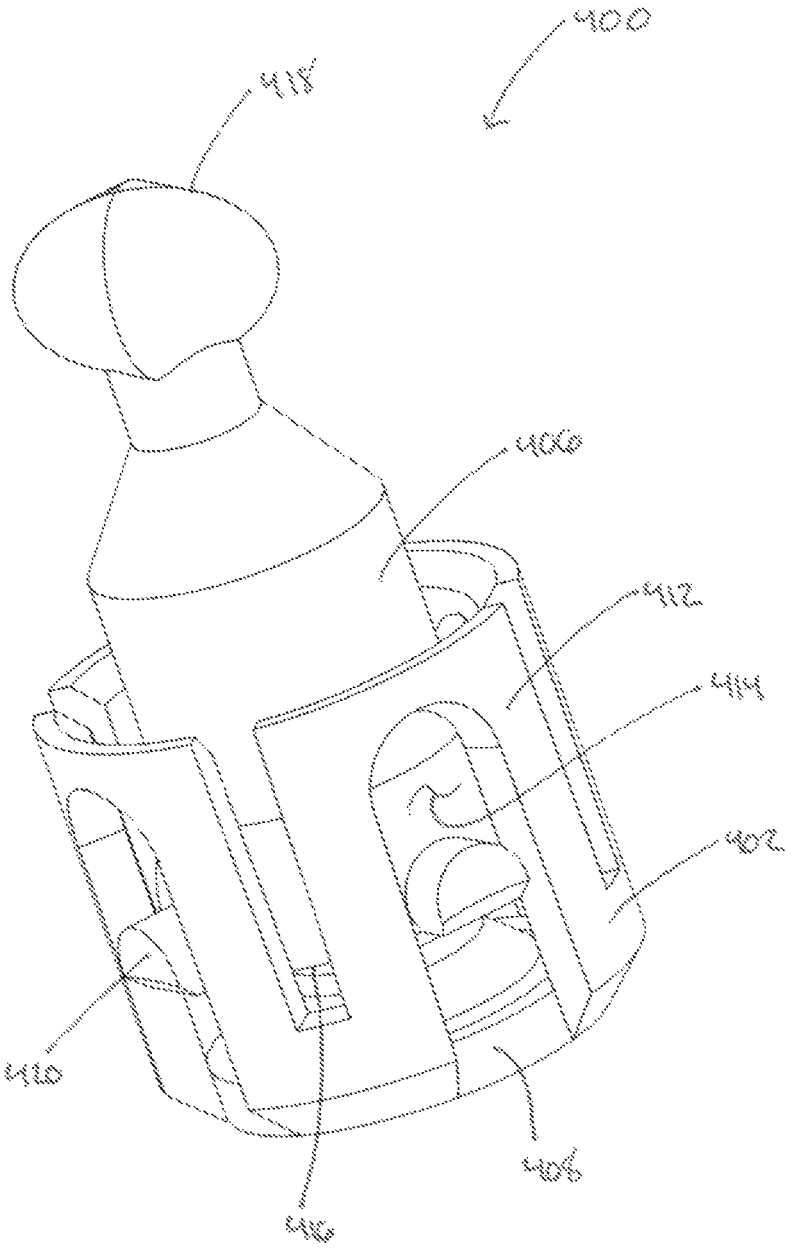
FIG. 14 is a perspective view of a torque transfer assembly for rotating the inner cutter of FIG. 1.
Figure 15:
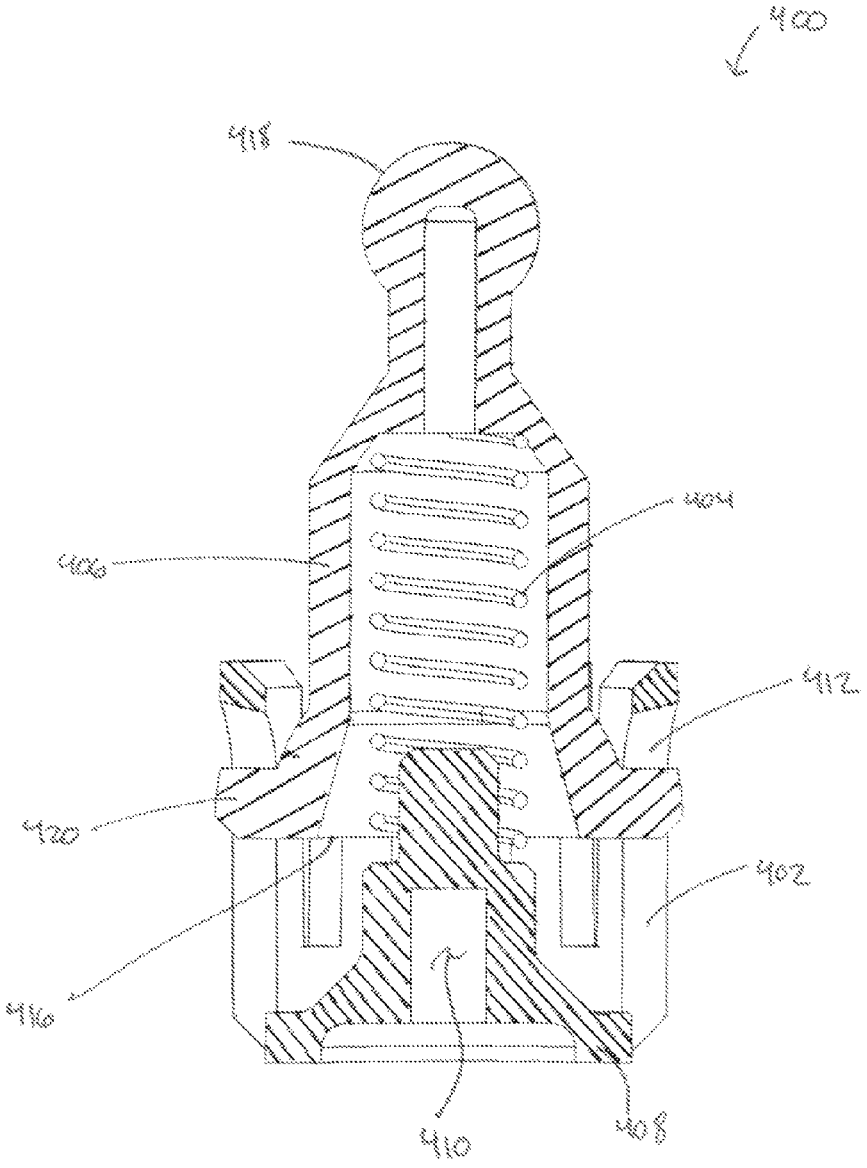
FIG. 15 is a cross-sectional view of the torque transfer assembly of FIG. 14.

FIGS. 14 and 15 illustrate a torque transfer assembly 400 for use in rotating and pivoting the blade 200 of the inner cutter 100 via the drive cap 300. The torque transfer assembly 400 generally includes a basket 402, a biasing member 404 (e.g., in the illustrated embodiment a coil spring) sized to be seated within the basket 402, and the drive pin 406 sized to be seated on the biasing member 404 within the basket 402. The basket 402 includes a bottom wall 408 defining a receptacle 410, and a generally cylindrical side wall 412 extending upward from the bottom wall 408 with a plurality of longitudinally extending channels 414 formed in the side wall 412. Suitably, the receptacle 410 is sized to receive a drive shaft that is operatively connected to the motor of the shaver, thereby enabling torque from the drive shaft to be transferred to the inner cutter 100 via the basket 402 and the drive pin 406.

The illustrated drive pin 406 is hollow and includes an open bottom 416 and a closed tip 418. The open bottom 416 has a plurality of guides 420 extending outward therefrom, wherein each guide 420 is sized to be inserted into, and to slide within, one of the channels 414 of the basket 402 such that the drive pin 406 is movable upward and downward within, and is rotatably immovable relative to, the basket 402. Suitably, the drive pin 406 is externally sized (e.g., in transverse cross-section) such that a space is left between the drive pin 406 and the side wall 412 of the basket 402 when the drive pin 406 is disposed within the basket 402, thereby enabling pivoting movement of the drive pin 406 relative to the basket 402. The drive pin 406 is also sized internally (e.g., in transverse cross-section) to receive the biasing member 404 such that the drive pin 406 is biased away from the bottom wall 408 of the basket 402. Additionally, the tip 418 of the drive pin 406 is generally polygonal when viewed from above (e.g., the tip 418 has a generally square cross-sectional shape in one embodiment) to facilitate insertion of the tip 418 into the socket 330 of the liner 304 for transferring torque from the basket 402 to the inner cutter 100 during a shaving operation (i.e., the generally polygonal tip 418 of the drive pin 406 is sized to mate with the generally polygonal socket 330 of the liner 304 such that rotation of the drive pin 406 causes the drive cap 300 to rotate).

In an assembled configuration of one embodiment of a shaver including the inner cutter 100 described above, the shaver includes a handle and a head mounted on the handle. An outer cutter blade (e.g., a stationary cutter blade) is mounted on the shaver head (e.g., pivotably mounted on the shaver head), and the blade 200 of the inner cutter 100 is disposed in shearing contact with the outer cutter blade. The blade 200 is connected to the drive cap 300 as described above, and the tip 418 of the drive pin 406 is inserted into the socket 330 of the drive cap 300. To operate the shaver, a user grasps the handle and activates the motor. The motor rotates the arrangement of gears and drive shafts of the shaver drive system, one of the drive shafts being inserted into the receptacle 410 of the basket 402. As such, the basket 402 rotates with the drive shaft, thereby rotating the drive pin 406 and the drive cap 300 for rotation of the blade 200 relative to the outer cutter blade of the shaver. The user then slides the outer cutter blade along the skin such that hairs from the skin are directed into slits of the outer cutter blade, wherein the hairs are cut via the rotating inner cutter blade 200.

As the outer cutter blade traverses contours of the skin (e.g., the contours of the user's face), the outer cutter blade is permitted to float and/or pivot to facilitate maintaining the outer cutter blade in contact with the skin. When the outer cutter blade floats or pivots, the inner cutter 100 floats or pivots in unison with the outer cutter blade, being that the inner cutter 100 is disposed within the outer cutter blade. As the inner cutter 100 floats/pivots, the basket 402 of the torque transfer assembly 400 is maintained in a fixed position relative to the drive shaft of the shaver because the basket 402 is fastened atop of the drive shaft via the receptacle 410. However, the drive pin 406 is permitted to float and pivot within the basket 402 against compression of the biasing member 404, thereby maintaining a driving engagement between the drive pin 406 and the drive cap 300 of the inner cutter 100 despite the floating and/or pivoting of the inner cutter 100. In this manner, the inner cutter blade 200 is maintained in shearing contact with the outer cutter blade while the outer cutter blade floats/pivots.

Depending upon the pivot angle of drive cap 300 (either at rest or during shaving), the entire surface of the tip 418 may not be in contact with the liner 304 at all times due in part, for example, to the pivot constraints of the drive pin 406 within the basket 402 (e.g., the drive cap 300 may be pivoted into an angle that the drive pin 406 cannot achieve). Thus, separation of the drive cap 300 from the tip 418 of the drive pin 406 may occur within the socket 330, which can result in increased noise or "chatter" associated with operation of the shaver as gaps between the rotating drive pin 406 and the rotating drive cap 300 open and close due to the inner cutter 100 and the drive pin 406 pivoting relative to one another. Because the material from which the liner 304 is manufactured (e.g., the TPU material) is softer than the material from which shell 302 and/or the tip 418 are manufactured, the liner 304 facilitates cushioning the connection between the drive pin 406 and the shell 302, thereby mitigating noise associated with shaver operation (i.e., the liner 304 absorbs impacts of the tip 418 against the drive cap 300 within the socket 330 during pivoting/floating of the inner cutter 100).

With this configuration, the drive cap 300 is configured to operatively connect the blade 200 to a motor of the rotary shaver. As such, the drive cap 300 and the torque transfer assembly 400 are components of a drive system of a rotary shaver, which also includes a motor, a gear arrangement, and at least one drive shaft. It is contemplated that any suitable component of the drive system (e.g., a drive shaft tip or a gear tooth) of any suitable shaver type (e.g., an oscillating shaver or a rotary shaver) may be configured with the liner 304 in a manner similar to that of drive cap 300 described above in order to facilitate mitigating noise associated with the interaction of the drive system components during operation. For example, in one suitable embodiment, the tip 418 of the drive pin 406 may be fitted with the liner 304 in lieu of, or in conjunction with, the shell 302 of the drive cap 300 being fitted with the liner 304.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An electric shaver comprising:

a handle;

a head connected to the handle, wherein the head comprises an outer cutter blade and an inner cutter blade arranged in shearing contact with the outer cutter blade; and a drive system comprising a motor and a plurality of drive components drivingly connecting the motor to the inner cutter blade for driving rotation of the inner cutter blade relative to the outer cutter blade, wherein the plurality of drive components comprises a first drive component and a second drive component connected to the first drive component, wherein at least one of the first drive component and the second drive component comprises a liner for cushioning the interface between the first drive component and the second drive component to mitigate noise associated with operation of the shaver.

2. The electric shaver set forth in claim 1 wherein the liner is formed from a thermoplastic elastomer (TPE) material.

3. The electric shaver set forth in claim 1 wherein the second drive component is configured to receive the first drive component.

4. The electric shaver set forth in claim 3 wherein the first drive component comprises the liner.

5. The electric shaver set forth in claim 3 wherein the second drive component comprises the liner.

6. The electric shaver set forth in claim 1 wherein the second drive component is pivotable relative to the first drive component.

7. The electric shaver set forth in claim 6 wherein the electric shaver is a rotary electric shaver, the outer cutter blade and the inner cutter blade being pivotable on the head of the shaver, wherein the first drive component and the second drive component are pivotably connected to one another such that the inner cutter blade is drivable during pivoting.

8. The electric shaver set forth in claim 7 wherein the first drive component is a drive pin and wherein the second drive component is a drive cap to which the inner cutter blade is connected, the drive cap having a socket defined by the liner such that the drive pin is insertable into the socket for driving the inner cutter blade.

9. The electric shaver set forth in claim 8 wherein the socket is generally polygonal and wherein the drive pin comprises a tip that is generally polygonal.

10. The electric shaver set forth in claim 8 wherein the drive cap comprises a shell having an interior lined by the liner to define the socket, the shell being formed from a first material having a first hardness, the liner being formed from a second material having a second hardness that is less than the first hardness.

11. The electric shaver set forth in claim 10 wherein the second material is a thermoplastic elastomer (TPE) material.

12. The electric shaver set forth in claim 10 wherein the liner and the shell are keyed to one another to facilitate preventing rotation of the liner relative to the shell.

13. An inner cutter for an electric shaver, said inner cutter comprising:

a blade; and a drive cap to which the blade is connected, the drive cap comprising a shell and a liner, wherein an interior of the shell is lined by the liner such that the liner defines a socket, the shell being formed from a first material having a first hardness, the liner being formed from a second material having a second hardness that is less than the first hardness.

14. The inner cutter set forth in claim 13 wherein the second material is a thermoplastic elastomer (TPE) material.

15. The inner cutter set forth in claim 13 wherein the liner and the shell are keyed to one another to facilitate preventing rotation of the liner relative to the shell.

16. The inner cutter set forth in claim 13 wherein the socket is configured to receive a drive component.

17. The inner cutter set forth in claim 16 wherein the socket is configured to permit pivoting of the drive cap on the drive component.

18. The inner cutter set forth in claim 16 wherein the socket is generally polygonal.

19. The inner cutter set forth in claim 18 wherein the generally polygonal socket has a generally square cross-sectional shape.

20. An electric shaver comprising:

a handle;

a head connected to the handle, wherein the head comprises an outer cutter blade and an inner cutter blade arranged in shearing contact with the outer cutter blade; and a drive system comprising a motor and a plurality of drive components drivingly connecting the motor to the inner cutter blade for driving the inner cutter blade relative to the outer cutter blade, wherein the plurality of drive components comprises:

a drive cap to which the inner cutter blade is connected, the drive cap comprising a shell and a liner, wherein an interior of the shell is lined by the liner such that the liner defines a socket, the shell being formed from a first material having a first hardness, the liner being formed from a second material having a second hardness that is less than the first hardness; and a torque transfer assembly comprising a basket, a biasing member seated within the basket, and a drive pin connected to the basket atop of the biasing member such that the drive pin is floatable, pivotable, and rotatably immovable relative to the basket, wherein the torque transfer assembly drivingly connects the motor to the drive cap with the drive pin inserted into the socket such that the liner cushions the interface between the drive pin and the drive cap to mitigate noise associated with operation of the shaver.

* * * * *